United States Patent [19]

St. George Syms

[11] 4,261,138

[45] Apr. 14, 1981

[54] CHRISTMAS TREE HOLDER

[76] Inventor: John G. St. George Syms, Willinghurst, Shamley Green, Nr. Guildford, Surrey GU5 ODU, England

[21] Appl. No.: 85,786

[22] Filed: Oct. 17, 1979

[30] Foreign Application Priority Data

Oct. 27, 1978 [GB] United Kingdom ..... 28682/79

[51] Int. Cl.[3] ..... A47G 33/12

[52] U.S. Cl. ..... 47/40.5; 248/523

[58] Field of Search ..... 47/40.5; 248/523–524

[56] References Cited

U.S. PATENT DOCUMENTS

| | | | |
|---|---|---|---|
| 417,815 | 12/1889 | Diek | 47/40.5 |
| 1,750,367 | 3/1930 | Smith | 47/40.5 X |
| 2,537,826 | 1/1951 | Hauser | 248/523 X |
| 2,609,169 | 9/1952 | Kroeger | 47/40.5 |
| 2,613,899 | 10/1952 | Wagner et al. | 47/40.5 |
| 2,701,699 | 2/1955 | Chapin | 47/40.5 |
| 2,855,168 | 10/1958 | Vigna | 47/40.5 |
| 3,298,643 | 1/1967 | Taylor | 47/40.5 |
| 3,302,909 | 2/1967 | Glassman | 47/40.5 |
| 3,332,649 | 7/1967 | Morrison | 47/40.5 |
| 3,719,340 | 3/1973 | Norton | 248/523 |
| 3,784,136 | 1/1974 | Lopez | 47/40.5 |
| 4,034,505 | 7/1977 | Lydall | 47/40.5 |

FOREIGN PATENT DOCUMENTS

| | | | |
|---|---|---|---|
| 2602657 | 10/1976 | Fed. Rep. of Germany | 248/523 X |
| 488751 | 7/1938 | United Kingdom . | |
| 505669 | 5/1939 | United Kingdom . | |
| 545486 | 5/1942 | United Kingdom . | |
| 1024545 | 3/1966 | United Kingdom . | |
| 1375938 | 12/1974 | United Kingdom . | |
| 1408428 | 10/1975 | United Kingdom . | |
| 1529155 | 10/1978 | United Kingdom . | |

*Primary Examiner*—Robert E. Bagwill

*Attorney, Agent, or Firm*—Shlesinger, Fitzsimmons & Shlesinger

[57] ABSTRACT

A Christmas tree holder comprises a container 1 resembling a bucket or flower pot, stabilizing feet 5 detachably connected to the container and a cover 7 seated in the open mouth of the container, the cover having a central aperture 12 which accommodates the trunk of a Christmas tree. Four serrated wedges 15 are provided which engage recesses 13 provided in the aperture 12 of the cover 7 and the Christmas tree trunk to secure the Christmas tree in position. Radially inwardly directed flanges are provided at the base of the interior of the container to locate the bottom of the trunk of the Christmas tree. Holes 14 are provided in the cover to enable the container 1 to be filled with water.

16 Claims, 4 Drawing Figures

1
2
3
4
5
6
7
8
10
11
13
14
15
16
17
18

CHRISTMAS TREE HOLDER

BACKGROUND TO THE INVENTION

The present invention relates to a Christmas tree holder.

There is a need for a Christmas tree holder which can be easily manufactured, which can be used stably to mount a Christmas tree, and which can be packaged and stored in a small space.

SUMMARY OF THE INVENTION

According to this invention there is provided a holder for holding a Christmas tree comprising a hollow container, a cover for the container defining an aperture and wedge means adapted to engage said aperture and the trunk of a tree located within the aperture to secure the tree in position.

Preferably said wedge means comprise a plurality of wedge members, each wedge member being of substantially right triangular shape.

Conveniently each wedge member has an included angle of substantially ten degrees.

Preferably the faces of each wedge member adapted to engage the tree and the said aperture are serrated.

Conveniently the cover is provided with a substantially circular aperture having substantially rectangular recesses therein, the wedge members being adapted to engage said recesses.

Advantageously each wedge is of right triangular shape and the hypotenuse comprises a face adapted to slide in one of said rectangular recesses.

Advantageously the container is provided with stabilising feet.

Preferably said stabilising feet are detachably connected to the said container.

Conveniently said container is provided with means on the interior thereof to locate the base of a tree trunk.

Conveniently said container is provided with radially inwardly directed flange means adapted to locate the base of the tree trunk.

Preferably the cover is substantially a friction fit within an open mouth of the container.

Advantageously the cover has a circular periphery with at least one notch therein and the said open mouth is circular with at least one inwardly directed protrusion corresponding to said notch, the arrangement being such that the cover may be inserted into said mouth when the notches and protrusions are co-aligned, and may subsequently be rotated so that the notches and protrusions are not co-aligned, the cover thus being locked in position.

Advantageously said component parts are moulded of a plastics material.

According to another aspect of this invention there is provided a kit of parts for forming a holder according to any one of the preceding claims comprising at least a container, a cover for the container defining an aperture and wedge means adapted to engage said aperture and the trunk of a tree.

Preferably the kit further includes stabilising feet adapted to be connected to the container.

BRIEF DESCRIPTION OF THE DRAWINGS

In order that the invention may be more readily understood, and so that further features thereof may be appreciated, the invention will now be described by way of example with reference to the accompanying drawings in which.

DESCRIPTION OF PREFERRED EMBODIMENT

Figure 1:
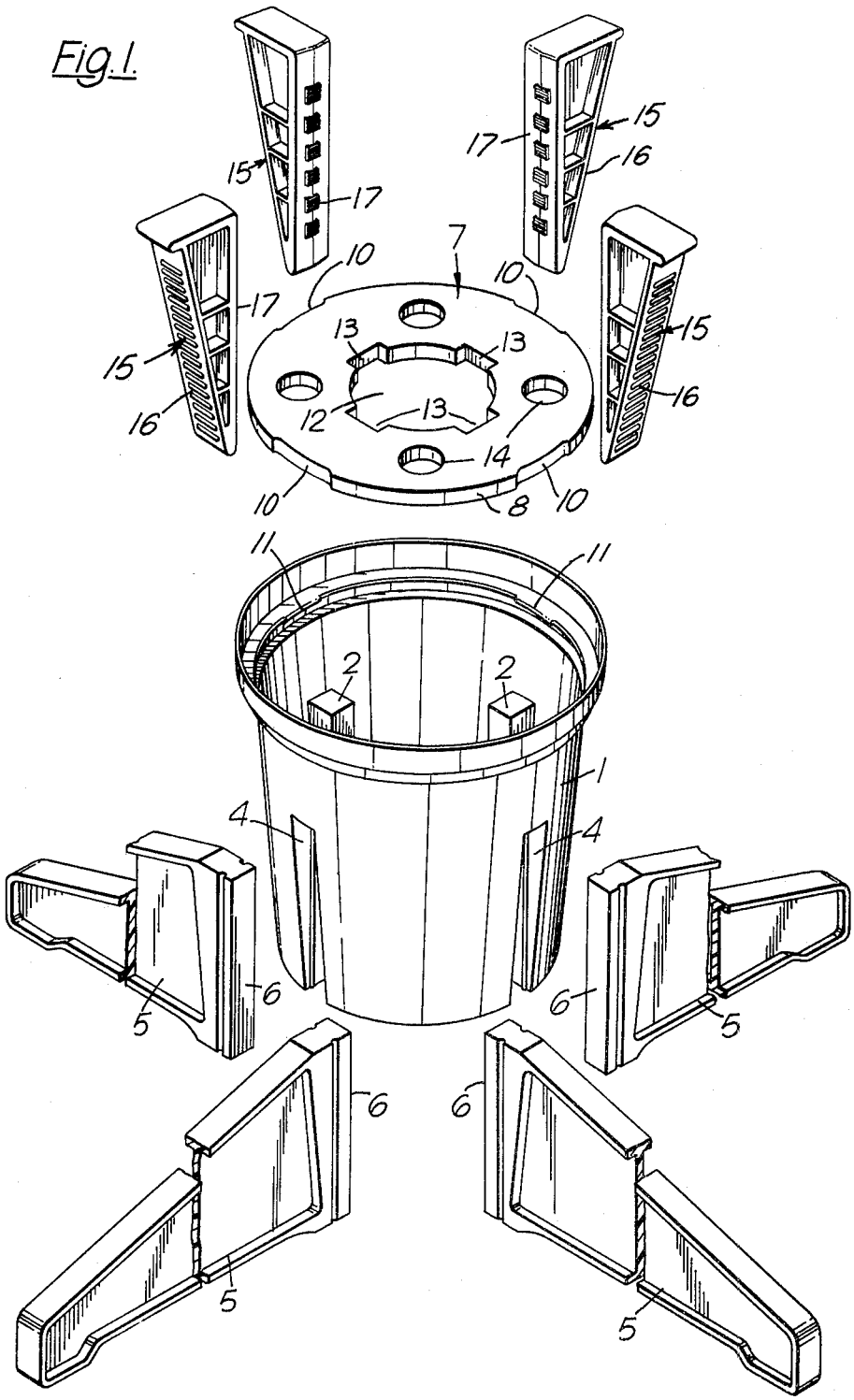
FIG. 1 is an exploded view of a Christmas tree stand in accordance with the present invention.

Referring to the accompanying drawings a Christmas tree stand in accordance with the present invention comprises a container 1 shaped like a flower pot or bucket, the container being formed of an appropriate moulding of a plastics material. The container 1 is provided with four protrusions 2 which protrude radially inwardly towards the centre of the container from the sidewalls. Each protrusion 2 terminates in a semi circular radially inwardly directed flange 3. The inwardly directed protrusions 2 are hollow, and corresponding slots 4 are defined on the exterior surface of the container which communicates with the hollow portion of the protrusions. Thus the protrusions define "T" sectioned channels, the stems of the "T" defining the said slots 4. Four steadying feet 5 are provided, each steadying foot comprising an elongate moulding of a plastics material and having, at one end thereof, a substantially "T" sectioned protrusion or guide member 6, this protrusion or guide member 6 being adapted to be inserted within the "T" sectioned channel present in one of the inwardly directed protrusions 2. It will be appreciated that when the four feet 5 have each had their respective guide member 6 inserted into a "T" sectional channel the container 1 may be placed on a floor or similar horizontal support surface and will have significant stability against toppling over.

A circular cover 7 is provided for the container 1, the cover 7 having a downwardly extending peripheral flange 8, the flange being dimensioned to be located within the open mouth of the container 1. The periphery of the cover 7 is provided with four equi-spaced notches or recesses 10. The upper region of the container 1 is stepped outwardly and the stepped portion is dimensioned to define a mouth in which the cover 7 is a friction fit. The portion that defines the mouth is provided with four inwardly directed protrusions 11, which are equi-spaced around the periphery of the mouth and which correspond, in shape and size, with the recesses. The cover 7 is provided with a central aperture 12 which is substantially circular but which has four rectangular equally spaced recesses 13 in the periphery thereof. Four circular apertures 14 are also provided within the cover 7. Four substantially triangular wedge members 15 are provided to complete the Christmas tree stand, the wedge members 15 each being dimensioned to slide in one of the recesses 13 of the aperture 12, with a face 16 of the wedge comprising the hypotenuse of the triangle, engaging the base of the corresponding recess 13, and with a face 17 comprising the longer remaining side being vertical. The face 16 is provided with a series of serrations so that the face 16 can lockingly engage the base of the recess 13. The face 17 has a series of groups of four serrations so that the face can engage the trunk of a Christmas tree.

Figures 2, 3, 4:
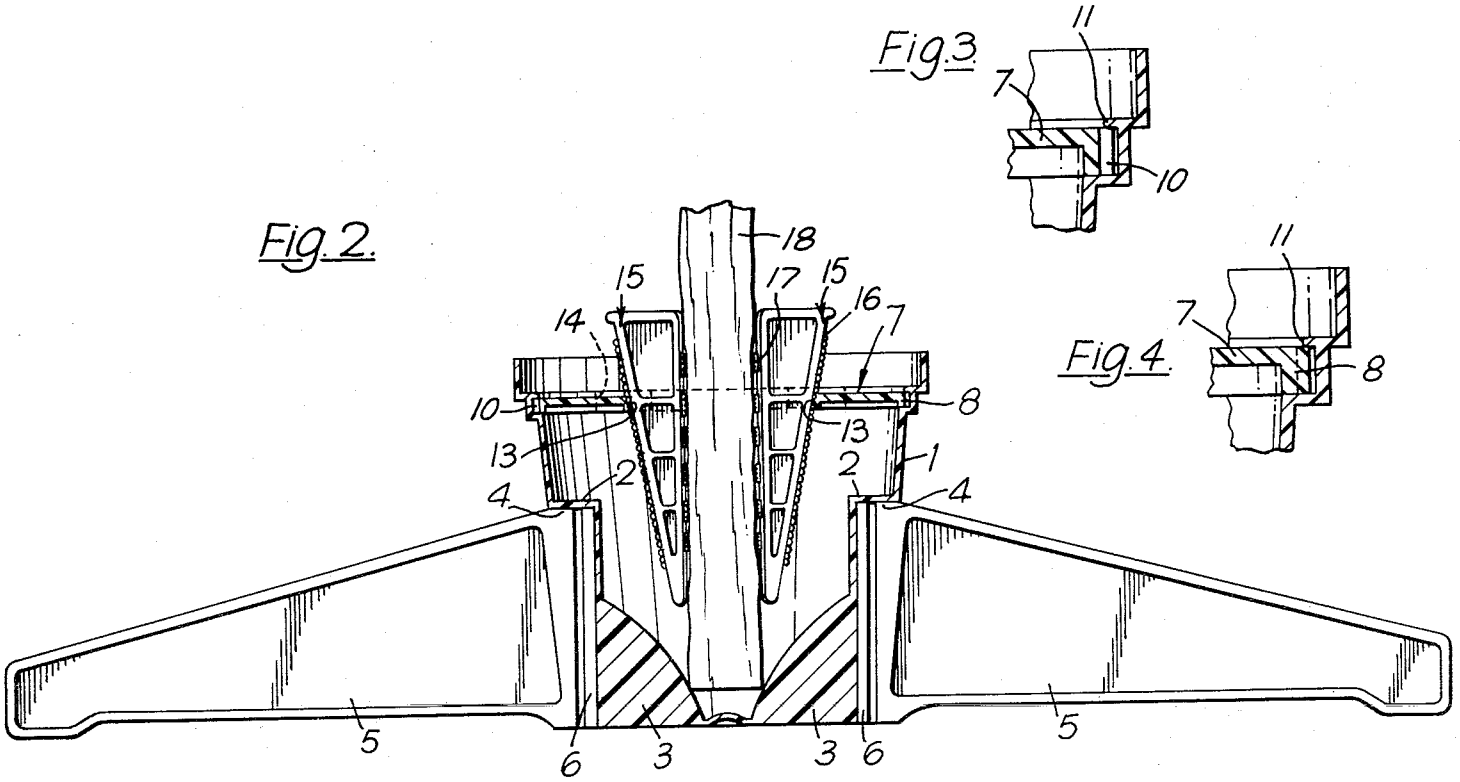
FIG. 2 is a cross-sectional view of the part erected Christmas tree stand showing a tree in position.
FIG. 3 is a portion of FIG. 2 on an enlarged scale.
FIG. 4 corresponds with FIG. 3 but illustrates the stand when fully erected.

In utilizing the Christmas tree stand the feet 4 are initially engaged with the container 1 and the container is placed on a horizontal surface. The cover 6 is then inserted into the mouth of the container, with the notches 10 and protrusions 11 co-aligned. This condition is illustrated in FIGS. 2 and 3. The cover is than rotated, a non-notched portion of the periphery of the cover then being firmly engaged under each protrusion 11, thus locking the cover 6 firmly in position. This condition is illustrated in FIG. 4. The trunk of a Christmas tree is then passed through the aperture 12 of the cover 7 and is then located in the space defined between the four semi-circular flanges 3. The flanges 3 tend to bite into the base of the tree. Subsequently the four wedge members 15, are inserted in the part rectangular recesses 13 forming part of the aperture 12. Each wedge member is located in position so that the face 16 formed by the hypotenuse of the right triangular shape engages the base of the recess 13 and so that face 17 comprising the second longest side of the right angled triangle is pressed firmly into contact with the trunk 18 of the Christmas tree. When the wedges have been driven into position the tree is firmly secured in place both by the action of the four co-operating wedges 15 which entirely surround the trunk of the tree and provide an even supporting force, and by the action of the four inwardly directed semi-circular flanges 3 at the base of the Christmas tree holder.

The Christmas tree may be watered whilst it is in the Christmas tree holder by tipping water through the apertures 14 provided in the cover. It is to be appreciated that if the container 1 is substantially filled with water, the tree will have an adequate water supply, and needle drop will be minimised. The water in the container 1 will also increase the overall stability of the tree in the stand. The level of water in the container 1 should be topped up regularly. It may prove desirable to saw a short length from the trunk of a tree before the tree is mounted in the stand, since when a tree is cut down a sealing process occurs which may subsequently inhibit the absorption of water by the tree. Of course, the container 1 may be filled with other material to increase the stability of the assembly, but the use of water is preferred.

It is envisaged that a Christmas tree stand in accordance with the present invention may be manufactured having a container with an overall height of less than 18 cm and an overall diameter of approximately 20 cm. It is envisaged that each foot will have an overall length of approximately 27 cm and each wedge member will have an overall length of approximately 14 cm and an included angle of 10 degrees. Thus a Christmas tree holder in accordance with the present invention may readily be collapsed and will occupy only a minimum space when the Christmas tree holder is not in use. It is envisaged that all the components of the Christmas tree holder may be moulded of plastics material.

I claim:

1. A holder for holding a Christmas tree comprising a hollow container; a removable cover for the container, said cover defining a substantially circular aperture having substantially rectangular recesses in the periphery thereof; and a plurality of wedge members each being adapted lockingly to engage said cover in one of said rectangular recesses, and the trunk of a Christmas tree located to pass through the aperture into the container, thereby to secure the Christmas tree in position.

2. A holder according to claim 1, wherein each wedge member is of substantially right triangular shape, each wedge member having an included angle of substantially ten degrees.

3. A holder according to claim 2, wherein the faces of each wedge member are adapted to engage the tree and said cover are serrated.

4. A holder according to claim 2, wherein the face defined by the hypotenuse of each wedge is adapted to slide in one of said rectangular recesses selectively into and out of locking engagement with said cover.

5. A holder according to claim 1, wherein said container is provided with stabilizing feet detachably connected to the container.

6. A holder according to claim 1, wherein said container is provided with radially inwardly directed flange means on the interior thereof to locate the base of a tree trunk.

7. A holder according to claim 1, wherein the components are all of moulded plastic material.

8. A holder according to claim 1, wherein the cover is substantially a friction fit within an open mouth of the container.

9. A holder for holding a Christmas tree comprising a hollow container, a removable cover for the container defining an aperture, and wedge means adapted to project into said aperture and into locking engagement with, respectively, said cover and the trunk of a Christmas tree located to pass through the aperture, thereby to secure the tree in position, said container being provided with radially inwardly directed flange means on the interior thereof adapted to locate the base of the tree trunk centrally in the container.

10. A holder according to claim 9, wherein said wedge means comprise a plurality of wedge members, each wedge member being of substantially right triangular shape, the faces of each wedge member adapted to engage the tree and said cover being serrated.

11. A holder according to claim 10 provided with stabilizing feet detachably connected to the container.

12. A holder for holding a Christmas tree comprising a hollow container, a removable cover for the container defining an aperture, and wedge means adapted lockingly to engage in said aperture and against the trunk of a tree located to pass through the aperture into the container, thus to secure the tree in position, said cover having a substantially circular outer periphery defining at least one notch therein, and the container having an open mouth, which open mouth is substantially circular and has at least one inwardly directed protrusion corresponding to said notch, the arrangement being such that the cover may be inserted into the mouth of said container when said notch and said protrusion are co-aligned, with the cover being movable downwardly below the level of the protrusion, the cover subsequently being rotatable so that the notch and protrusion are not co-aligned, the cover thus being locked in position in the container.

13. A holder according to claim 12, wherein the container is provided with means on the interior thereof to locate the base of a tree trunk, said locating means comprising radially inwardly directed flange means.

14. A holder according to claim 13, wherein all the component parts of the Christmas tree holder are moulded of plastic material.

15. A holder for holding a Christmas tree comprising a hollow container, a removable cover for the container, said cover defining a substantially circular aperture having substantially rectangular recesses in the periphery thereof; and a plurality of wedge members each being adapted to extend into one of said rectangular recesses and lockingly to engage both said cover and the trunk of a Christmas tree located to pass through the aperture into the container, thus to secure the Christmas tree in position, each wedge member being of substantially right triangular shape, the faces of each wedge member adapted to engage the tree and said cover being serrated, said cover having a substantially circular periphery defining at least one notch therein, and the container having an open mouth which is substantially circular, and having at least one inwardly directed protrusion corresponding to said notch, the arrangement being such that the cover may be inserted into the mouth when said notch and said protrusion are co-aligned, with the cover being moved downwardly below the level of the protrusion, the cover subsequently being rotated so that the notch and protrusion are not co-aligned, the cover thus being locked in position.

16. A holder according to claim 15, wherein the container is provided with stabilizing feet detachably connected to the container, and the container is provided with radially inwardly directed flange means on the interior thereof to locate therein the base of a tree trunk, and wherein all the component parts of the Christmas tree holder are made of plastic material.

* * * * *

UNITED STATES PATENT OFFICE

CERTIFICATE OF CORRECTION

Patent No. 4,261,138 Dated April 14, 1981

Inventor(s) John G. St. George Syms

It is certified that error appears in the above-identified patent and that said Letters Patent are hereby corrected as shown below:

On the title page, under (30) Foreign Application Prioity Data, the Serial No. "28682/79" should be --42225/78--.

Signed and Sealed this

Fourteenth Day of July 1981

[SEAL]

Attest:

GERALD J. MOSSINGHOFF

Attesting Officer

Commissioner of Patents and Trademarks